US005647483A

United States Patent [19]

Harris

[11] Patent Number: 5,647,483

[45] Date of Patent: Jul. 15, 1997

[54] ARTICLE CARRIER WITH REINFORCED HANDLE

[75] Inventor: Randall L. Harris, Powder Springs, Ga.

[73] Assignee: Riverwood International Corporation, Atlanta, Ga.

[21] Appl. No.: 605,386

[22] Filed: Feb. 23, 1996

[51] Int. Cl.[6] ..... B65D 65/00

[52] U.S. Cl. ..... 206/427; 206/434

[58] Field of Search ..... 206/427, 153, 206/434

[56] References Cited

U.S. PATENT DOCUMENTS

| | | | |
|---|---|---|---|
| 3,904,036 | 9/1975 | Forrer | 206/427 |
| 4,331,289 | 5/1982 | Killy | 206/427 |
| 4,538,759 | 9/1985 | Dutcher | 206/427 |
| 4,588,084 | 5/1986 | Holley, Jr. | 206/427 |

*Primary Examiner*—Paul T. Sewell
*Assistant Examiner*—Nhan T. Lam

[57] ABSTRACT

A carrier for bottles. The handle area of the top panel is reinforced by a strap connected at its ends to a dust flap in each end panel. The strap is adhered to the top panel and potions of the upper end panel flaps, while the portions extending to the dust flaps comprise gusset webs. During formation of a carrier from an erected flattened tube, the dust flaps connected to the reinforcing strap are automatically closed upon raising the upper end panel flaps. This pulls the upper dust flap portions in against the bottle necks, providing a tight fit with between the bottles and the upper portions of the carrier.

19 Claims, 5 Drawing Sheets

ARTICLE CARRIER WITH REINFORCED HANDLE

FIELD OF THE INVENTION

This invention relates to a sleeve-type carrier for packaging articles such as beverage bottles. More particularly, it relates to a sleeve-type carrier having a reinforced handle.

BACKGROUND OF THE INVENTION

Sleeve-type carriers conventionally are manufactured from an elongated blank having a side panel section at one end and either the bottom panel section or the top panel section at the other end. The blank is formed into a flattened tube by folding the end sections in and adhering them to each other by a glue flap on one of the end sections. This flattened tube, or collapsed carrier as it is sometimes called, is then shipped to a packaging plant where it is erected into tube shape, filled with the articles being packaged and closed in at its ends.

A handle in the form of openings in the top panel conventionally is provided to enable the carrier to be more easily lifted. If the carrier load is relatively light, such as, for example, when packaging six beverage bottles, the handle openings may take the form of finger holes spaced apart along the length of the carrier. If the load is relatively great, as in a carrier for packaging twelve or more beverage bottles, the handle openings are typically elongated hand openings spaced apart across the width of the carrier. When the carrier is lifted, the strap-like portion of the top panel between the hand openings is subjected to a great deal of stress and can be in danger of tearing if it is not of suitable strength.

Various designs have been proposed to strengthen the handle area, primarily by making it of greater thickness than the rest of the top panel. One way of accomplishing this has been to overlap the end portions of top panel flaps to provide a multi-ply thickness between the handle openings. In a carrier where the top panel is not formed of flaps but is a continuous section of the carrier blank, reinforcement has been achieved by adhering strips of material to the area between the handle openings prior to fabricating the carrier. This is not a desirable method, however, as it slows the carrier fabrication process and increases the cost of the carrier.

A separate and different problem encountered, especially in the packaging of beverage bottles where at least the end panels of the carrier are inwardly tapered toward the top panel, is the difficulty in folding the end panel flaps against the bottles to make a tight package. In particular, difficulties are encountered in maintaining the upper tapered portion of the end panel dust flaps in contact with the bottles while at the same time folding the upper end flaps down against the dust flaps. If the upper end flaps are glued to dust flaps which have not been moved inwardly as far as they should have been, a loose package can result in which the end bottles are not held at their necks as tightly as desired. The lower portions of the dust flaps normally do not have such a problem since they immediately contact the substantially vertical body portion of the end bottles upon being folded into place.

It would be highly desirable to be able to reinforce the handle area of a sleeve-type carrier in a manner which is effective yet economical. It would also be desirable to be able to assure a tight fit between packaged bottles and the end panels of a carrier. It is an object of the invention to provide a carrier which achieves both goals.

BRIEF SUMMARY OF THE INVENTION

The invention is incorporated in an enclosed article carrier of the type in which the end panels include an upper end panel flap adhered to dust flaps extending in from the side panels. One portion of a reinforcing strap is adhered to the inner face of the top panel between two transversely spaced handle openings and a second portion extends from the top panel to an integral connection with a dust flap. This arrangement allows the reinforcing strap to be an integral part of the carrier blank. During formation of a carrier from an erected flattened carrier tube, the dust flaps connected to the reinforcing strap are automatically closed when the upper end panel flaps are raised, which pulls the upper dust flap portions in against the packaged articles and provides a tight fit. The invention thus provides for additional reinforcement as well as improved carrier formation due to the unique manner in which the reinforcement strap is designed.

In a preferred design the second portion of the reinforcing strap is connected by a fold line to a dust flap edge located intermediate the top and bottom panels, and comprises a gusset web which allows the second portion to be folded into place upon formation of a carrier.

The invention is of special utility in tapered carriers utilized to package tapered articles, such as beverage bottles. It is not limited to a single reinforcement ply in the handle area. If desired, one or more additional reinforcement plies may be provided, as explained below.

These and other features and aspects of the invention will be readily ascertained from the detailed description of the preferred embodiments described below.

DETAILED DESCRIPTION OF THE PREFERRED EMBODIMENTS

Figure 1:
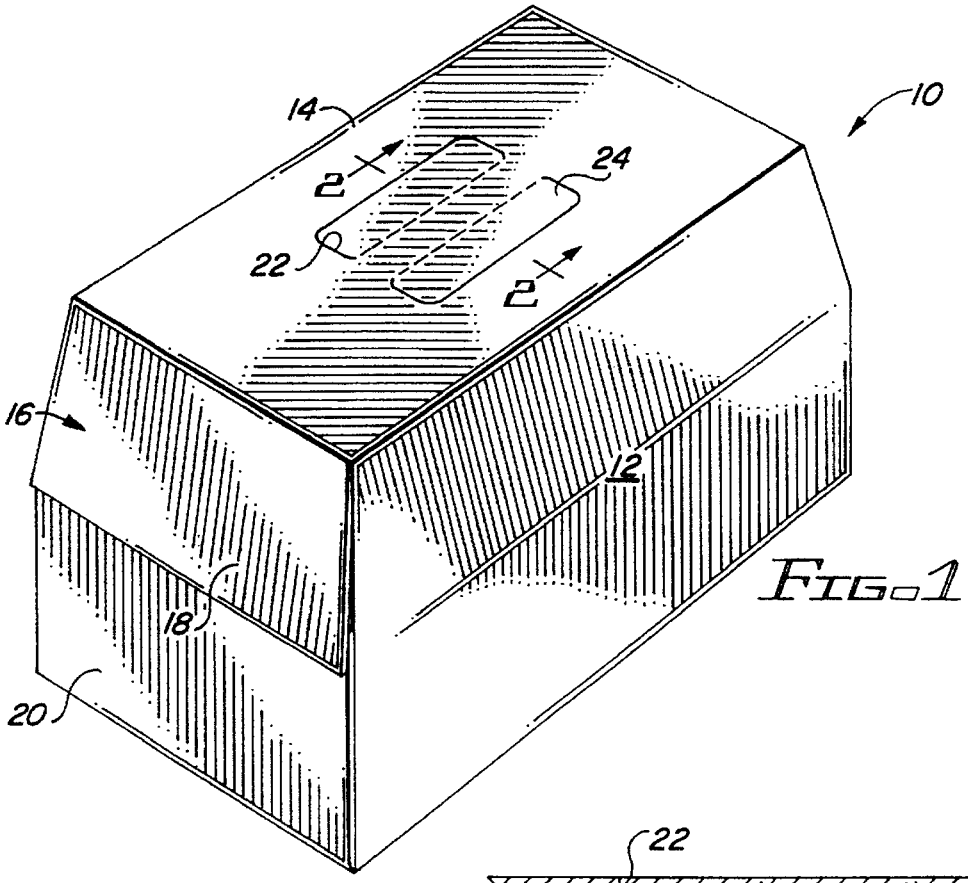
FIG. 1 is a pictorial view of an enclosed sleeve-type carrier incorporating the invention.
Figure 2:
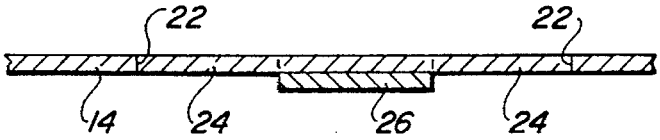
FIG. 2 is a partial sectional view of the top panel handle area taken on line 2—2 of FIG. 1.

Referring to FIG. 1, a carrier 10 incorporating the features of the invention is a fully enclosed sleeve-type carrier for receiving twelve bottles arranged in three rows of four bottles each. It is comprised of a near side panel 12 and an opposite side panel 13 which cannot be seen in this view. Both side panels are foldably connected to top panel 14 and to a bottom panel, not visible in this view. The carrier also includes end panels 16 formed by dust flaps which are folded in from the side panels and are adhered to upper and lower end panel flaps 18 and 20. The bottom panel is longer and wider than the top panel, and the upper portions of the side and end panels taper in to the top panel. This enables the wider body portions of the bottles to snugly fit in the lower portion of the carrier and the tapered necks of the bottles to closely fit in the upper tapered portions of the carrier. Spaced elongated handle openings 22 in the top panel, which are covered by flaps 24, serve as hand openings. As seen in FIG. 2, the top panel is reinforced between the openings 22 by a strap 26, making the top panel of two-ply construction in this area.

Figure 3:
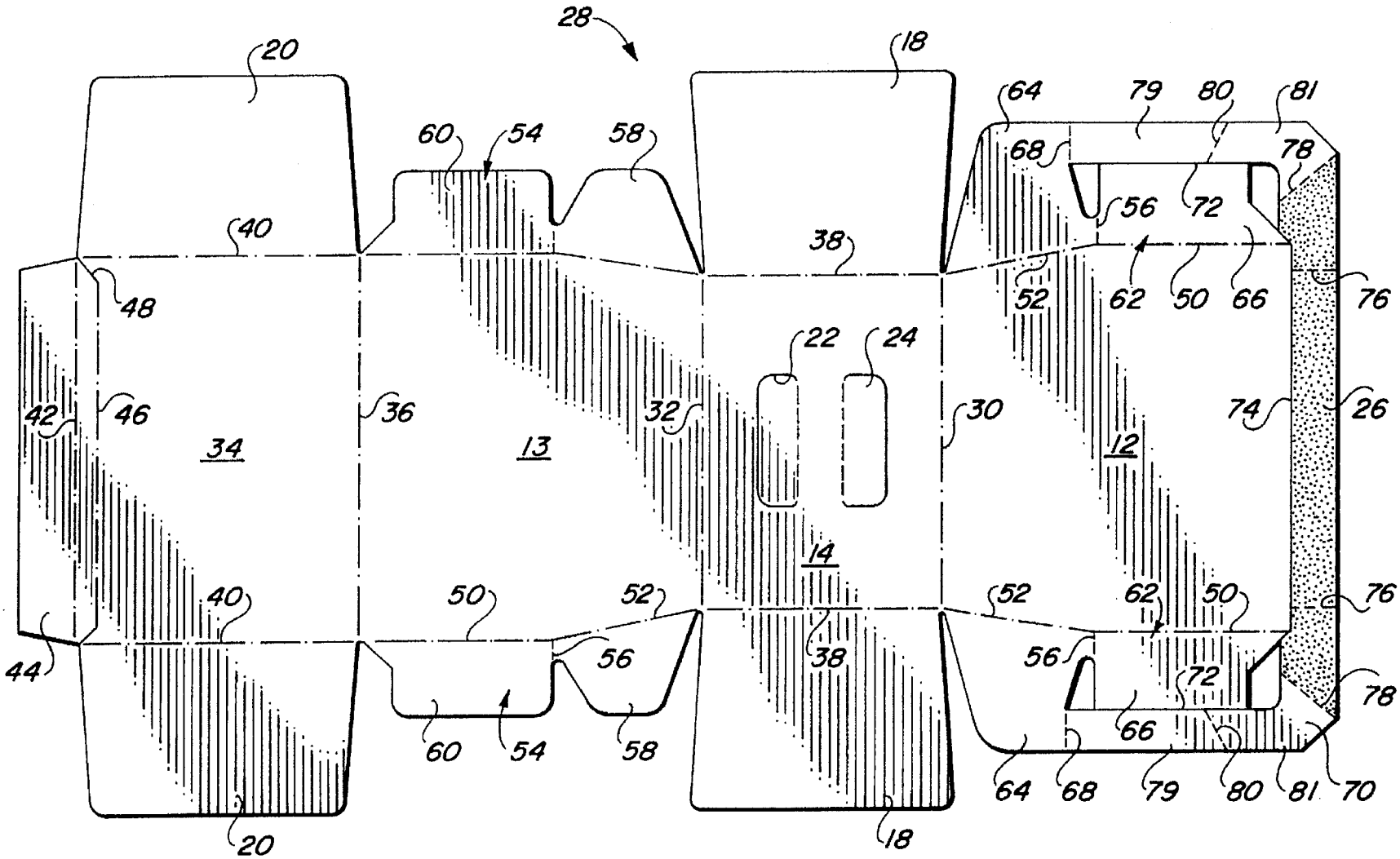
FIG. 3 is a plan view of a blank for fabricating the carrier of FIG. 1.

The carrier is formed from the blank 28 shown in FIG. 3. The basic layout of the blank is similar to that of conventional blanks for forming enclosed carriers, comprising top panel section 14 connected by fold lines 30 and 32 to side panel sections 12 and 13, with the interior side panel section 13 being connected to bottom panel section 34 by fold line 36. The upper end panel flaps 18 are connected to the top panel section 14 by fold lines 38 and the lower end panel flaps 20 are connected to the bottom panel section 34 by fold lines 40. Connected to the bottom panel section 34 by fold line 42 is glue flap 44, and spaced from the fold line 42 in the bottom panel section is a parallel false score or intermediate fold line 46. Slits 48 in the bottom panel section connect the ends of the false score 46 to the outer ends of the fold lines 40.

Connected to opposite ends of the side panel section 13 by converging fold lines 50 and 52 are opposite dust flaps 54. A score line 56 in the dust flaps at the juncture of the fold lines 50 and 52 divides the dust flaps into upper and lower segments 58 and 60. The score line 56 allows the upper dust flap segments 58 to fold in about the fold line 52 against the neck of an adjacent bottle. The side panel section 12 is connected at opposite ends by converging fold lines 50 and 52 to dust flaps 62 which are divided by fold line 56 into upper and lower segments 64 and 66. While the outer edges of the upper and lower dust flap segments 58 and 60 are substantially aligned, the outer edge of the upper dust flap segments 64 extends out beyond the outer edge of the lower dust flap segments 66. This additional width of the dust flap segments 64 allows the segments to be connected by fold lines 68 to the ends of U-shaped band 70. The band 70 is separated from the outer edge of the lower dust flap segments 66 by slits 72 and from the end edge of the side panel section 12 by slit 74. The band includes a pair of fold lines 76 which are aligned with the fold lines 38, and two pairs of angled fold lines 78 and 80, the locations of which are determined as explained below. The portion of the band which extends between the fold lines 78 corresponds to the strap 26 shown in FIG. 2, while the portions between the fold lines 68 and 78 function as gusset webs containing the interior fold line 80. The segments of the gusset webs between the fold lines 68 and 80 are indicated at 79, while the segments between the fold lines 80 and 78 are indicated at 81.

To form a carrier from the blank the first step is to fold the band about the fold lines 68 and glue the stippled portion of the band shown in FIG. 3 to the top panel section 14. This step produces the interim blank shown in FIG. 4. Note that the fold lines 76 are aligned with and overlie the fold lines 38, and that the width of the strap portion of the band is substantially the same as the distance between the handle openings 22. The width of the strap portion and the distance from the fold lines 68 to the edges of the strap portion will have been selected so as to cause the strap portion to assume the position shown in FIG. 4 when the band is folded as described.

Figure 4:
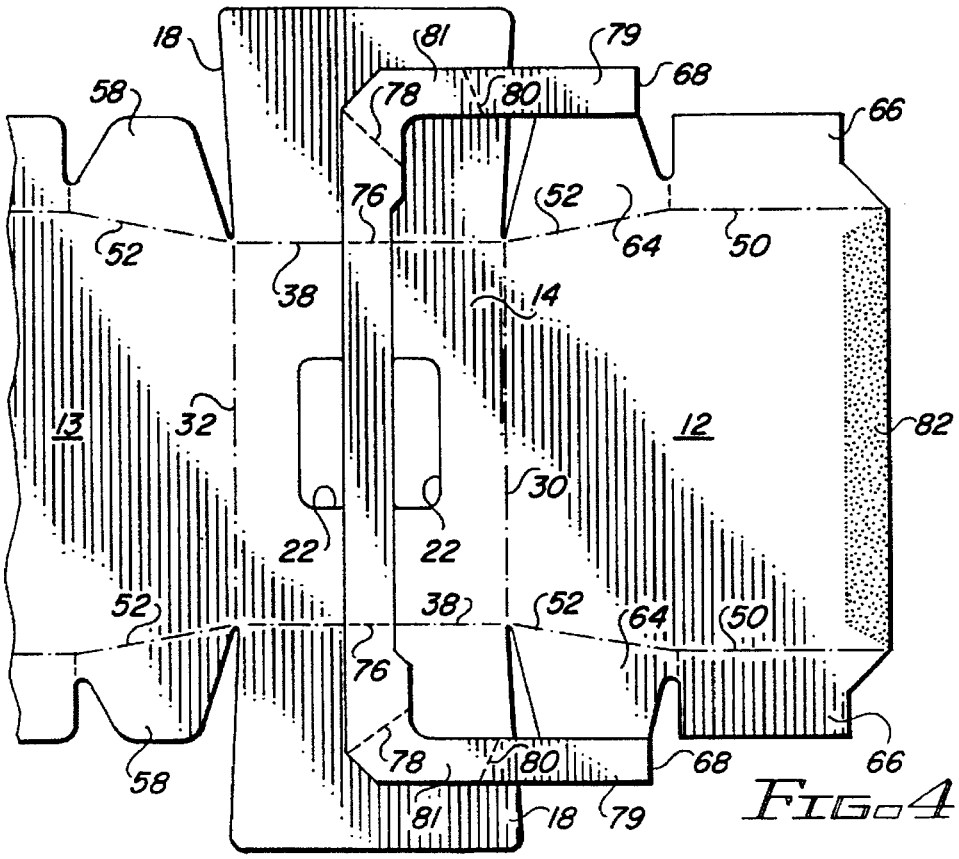
FIG. 4 is a partial plan view of the blank of FIG. 3 at an interim stage of carrier fabrication.
Figure 5:
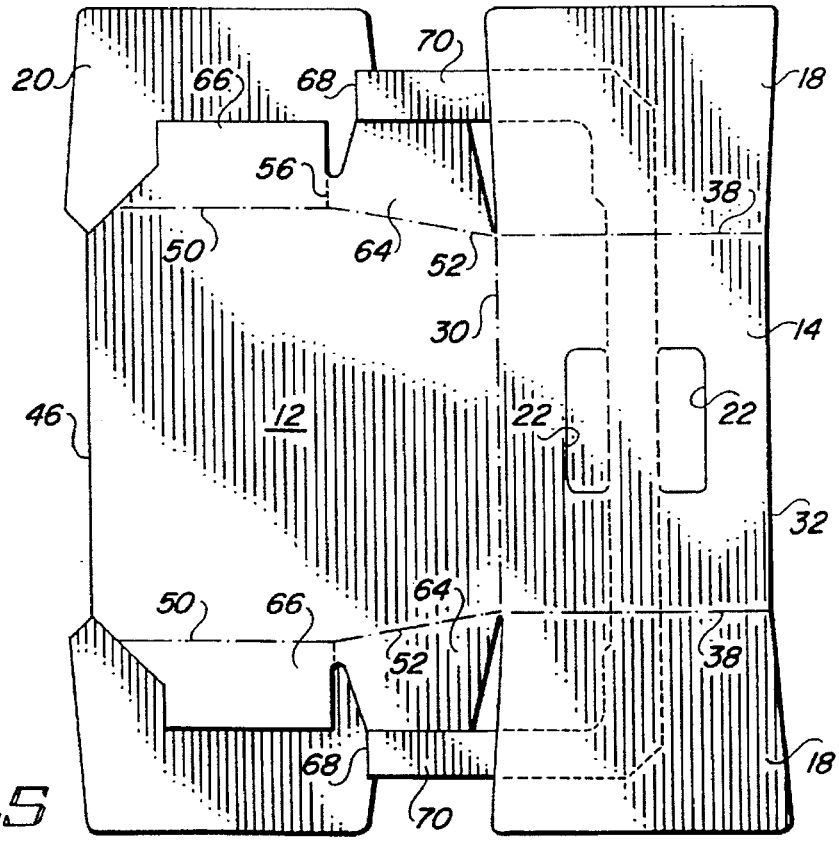
FIG. 5 is a plan view of a collapsed carrier formed from the blank of FIG. 3.

Referring to both FIGS. 3 and 4, to form a flat collapsed carrier from the interim form of blank shown in FIG. 4, the glue flap 44 and the adjacent minor portion of the bottom panel section 34 between the glue flap and the intermediate fold line 46 are folded in about the intermediate fold line. Glue is then applied either to the folded glue flap 44 or to a correspondingly shaped portion 82 at the end of side panel section 12, as shown in stipple in FIG. 4. The side panel section 12 and the top panel section 14 are then pivoted as a unit about the fold line 32 to bring the stippled portion 82 into contact with the glue flap, adhering these surfaces to each other. The resulting collapsed carrier is shown in FIG. 5, with the portions of the band 70 which are hidden beneath the top panel section 14 and the upper end panel flaps 18 shown in dotted lines.

Note that the collapsed carrier is now in flattened condition, ready for shipment to a packaging site. Even though the width of the top panel section is less than the width of the bottom panel section, by making the false score 46 an operative fold line it is possible to fold the sleeve into the flattened condition illustrated. The false score would of course not be necessary if the widths of the top and bottom panels were the same. It will be understood by those skilled in the art that a false score could be provided instead in the top or side panels and, except for necessitating a different folding procedure, would produce a final carrier similar to the carrier 10.

The collapsed carrier is erected to form a tube or sleeve by applying inward pressure to the folds 46 and 32 at the ends of the collapsed carrier, as is well known in the industry. When initially erected the tube will not yet be square because the false score or intermediate fold line 46 will still be operative, leaving the minor area of the bottom panel between the intermediate fold line 46 and the glue flap 44 in the same plane as the lower portion of the side panel 12. Elements of the packaging machine or the incoming bottles themselves will force the minor area of the bottom panel into the plane of the bottom panel, making the glue flap fold line 42 the operative fold line and causing the erected carrier to be squared.

Figure 6:
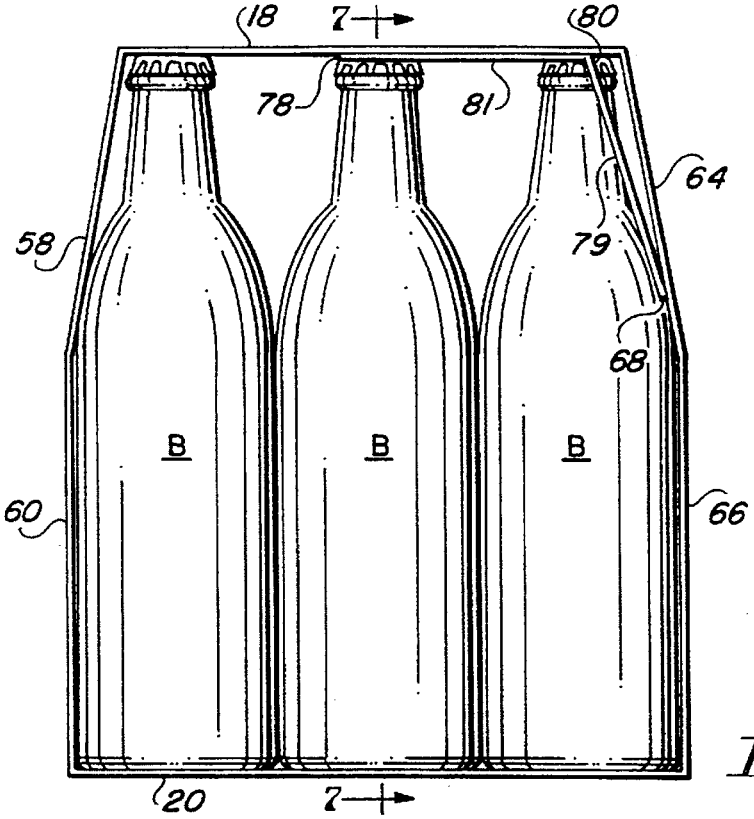
FIG. 6 is an end view of an erected and loaded carrier prior to the folding of the end panel flaps.
Figure 7:
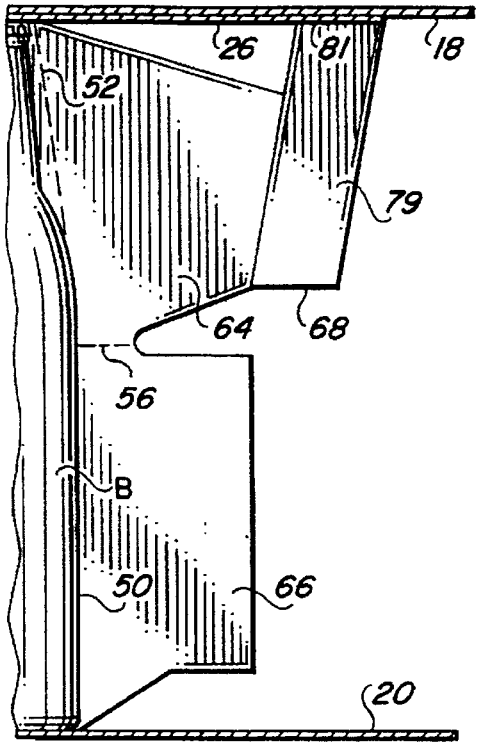
FIG. 7 is a sectional view taken on line 7—7 of FIG. 6.

Once the carrier is erected, bottles B are introduced through one or both of the open ends. At this point the upper and lower end flaps 18 and 20 and the dust flaps will not yet have been folded, but as illustrated in FIGS. 6 and 7 portions of the band 70 will have been folded as a result of folding the carrier blank into a collapsed carrier and then erecting the collapsed carrier to form an open-ended tube. Specifically, the segment 79 will have been folded about the fold line 68 as the first step in forming a collapsed carrier and will have been folded about the fold line 80 as a result of the carrier erecting process. It will be understood that although the band segment 79 is illustrated as partially blocking the open end of the erected carrier, the bottles can readily be inserted into the carrier sleeve, such as by introducing them in staggered formation followed by a final alignment step or by introducing them at a slight angle so as to avoid the reinforcing band segment.

Figure 8:
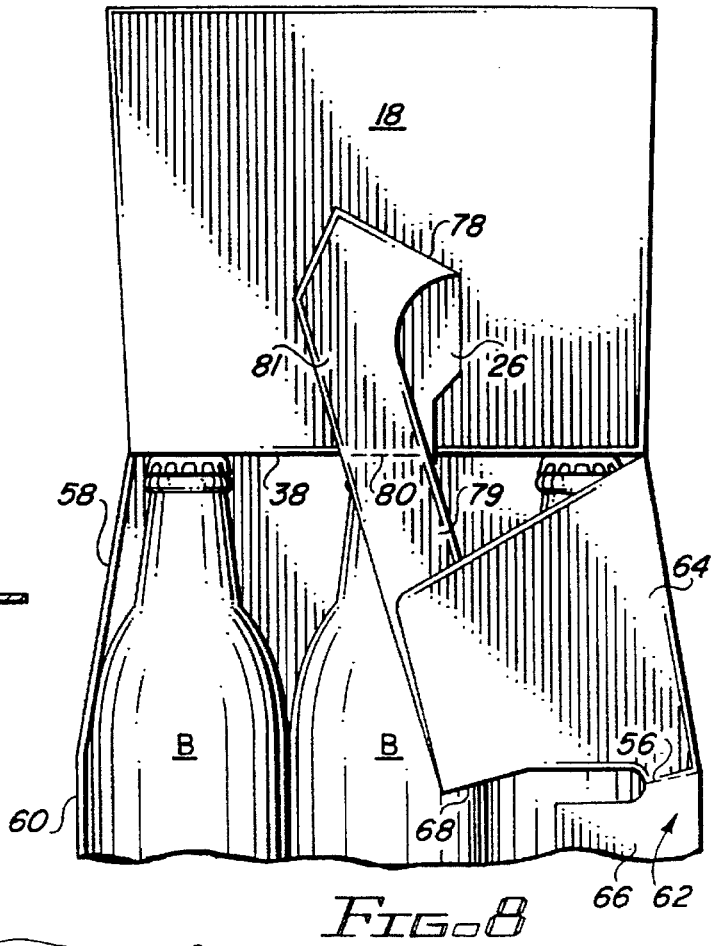
FIG. 8 is a partial end view of the erected carrier of FIG. 6 at a further interim stage of carrier fabrication.

The next step is to close in the ends of the carrier, which is initiated by pivoting the upper end flap 18 up. As shown in FIG. 8, when this occurs the upward movement of the fold line 78 and the movement of the band segment 81 away from the upper end panel flap 18 causes the band segments 81 and 79 to pull the connected upper dust flap 64 to its closed position. The lower dust flap 66 also folds into closed position along with the upper dust flap 64. The band segments 79 and 81 are still essentially a continuous strip since the fold line 80 connecting them remains unfolded. The fold line 80 is now positioned adjacent the fold line 38 connecting the upper end panel flap 18 to the top panel.

Figure 9:
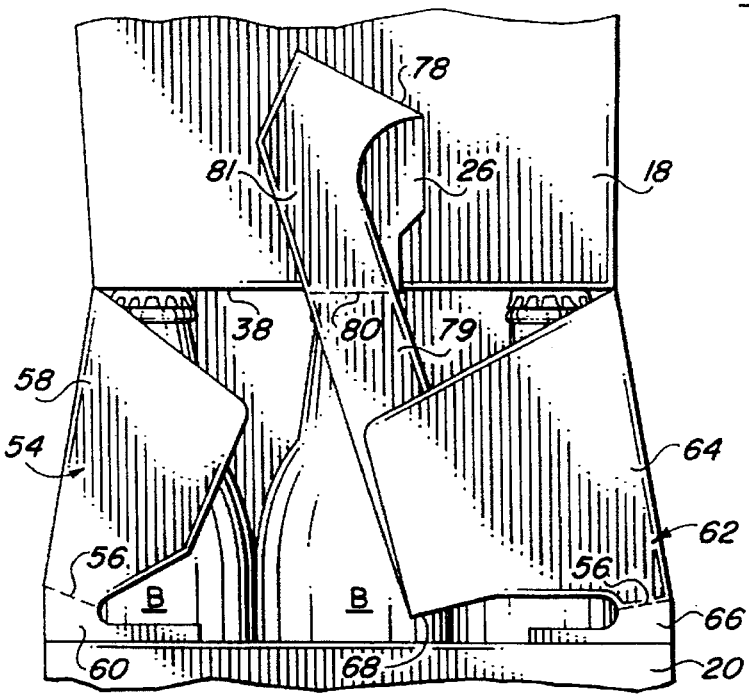
FIG. 9 is a partial end view of the erected carrier at the next interim stage of carrier fabrication.
Figure 10:
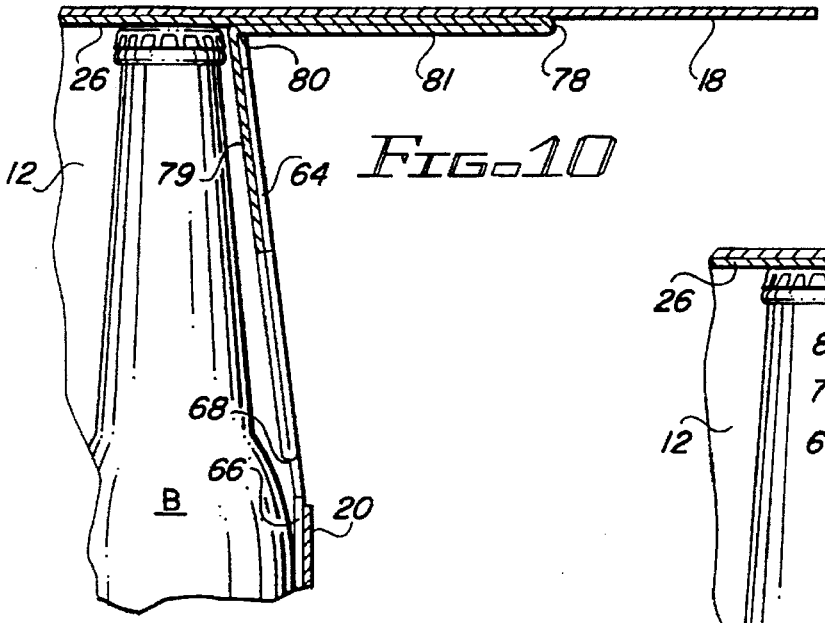
FIG. 10 is a partial longitudinal sectional view taken on the centerline of the erected carrier at a still further stage of carrier fabrication.
Figure 11:
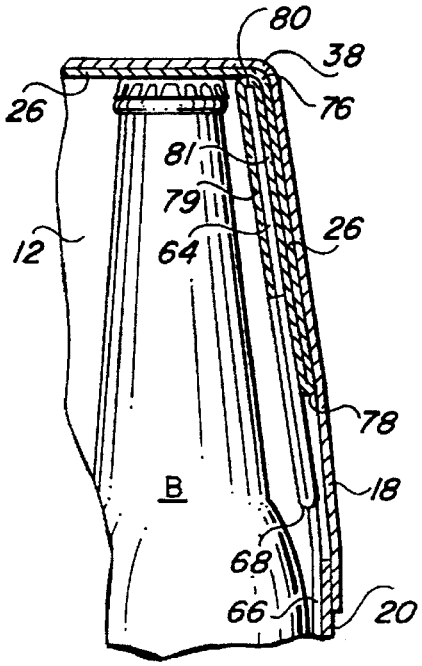
FIG. 11 is a partial longitudinal sectional view taken on the centerline of a completed carrier.

The next step is to fold in the dust flaps at the other edge of the end opening, fold up the lower end flap 20 and glue the lower end flap to the lower dust flaps, which results in the interim carrier illustrated in FIG. 9. This is followed by pivoting the upper end flap 18 down and gluing it to the upper dust flaps and an overlapped portion of the lower end flap 20. During the downward pivoting of the upper end flap the segment 81 of the gusset web portion of the reinforcing band will fold down about the fold line 80. This is illustrated in FIG. 10, which shows the upper end panel flap 18 and the band segment 81 as they are moving through the plane of the top panel toward their final end panel positions. As shown in FIG. 11, in the final end panel formation the band segment 81 lies between the upper dust flap 64 and the upper end panel flap 18 and is glued in place along with the upper end panel flap.

It can now be appreciated that the reinforcing band provides a dual function. The strap portion 26 adhered to the underside of the top panel provides a two-ply thickness in the handle area between the handle openings 22. In addition, the automatic closing of the dust flaps 62 upon the upward pivoting of the upper end panel flap 18 creates the taut interim condition of the gusset web segments 79 and 81 shown in FIGS. 8 and 9. The raised upper end flap 18 pulls the upper dust flap portion 64 and the web segments 79 and 80 toward the interior of the carrier, thus holding the upper dust flap portions 64 and the segments 79 and 80 against the adjacent end bottles as the other dust flaps 54 and the lower end panel flaps 20 are folded into place. This produces a tight package since it overcomes the previous difficulty of holding the upper dust flap portions in place during the end panel forming process. It is sufficient that only the dust flaps 62 and the connected gusset web segments carry out this initial end panel forming step inasmuch as their movement to the final end panel position establishes the final location of the other dust flaps 54 and the upper end panel flaps.

These benefits are achieved without necessitating a separate reinforcing strap and without employing packaging machine elements to attempt to hold the upper dust flap portions in place during the final steps of carrier formation.

As indicated above, the location of the fold lines 68 which attach the band 70 to the carrier blank is such that the band can be folded into place so that the strap section 26 lies between the handle openings. The fold lines 80 are located on the band at angle so that they substantially coincide with the fold line connecting the associated upper end panel flap 18 to the top panel. The other fold lines 78 are at a 45° angle to the fold lines 30 and 38 in the carrier blank of the preferred embodiment. This provides for the change in direction of the band from the strap section 26 to the gusset segment 81 in a carrier formed from the blank.

Figure 12:
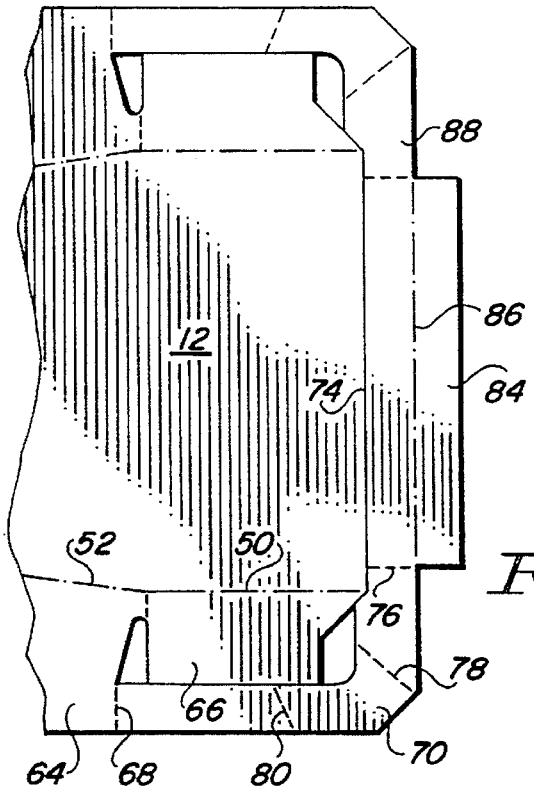
FIG. 12 is a partial plan view of a blank for forming a modified carrier.
Figure 13:
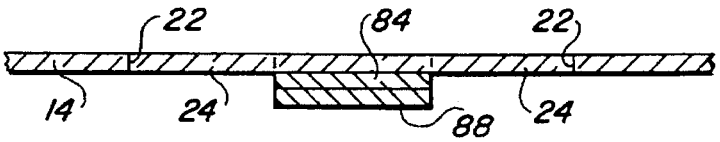
FIG. 13 is a partial sectional view of the top panel handle area of a modified carrier formed from the blank of FIG. 12.

Referring now to FIG. 12, the reinforcement band 70 may be modified to provide for additional plies in the handle area. In this modification a flap 84 is connected by fold line 86 to the strap section 88. When forming the carrier, prior to folding the band in place flap 84 is folded over and glued to the strap section 88. In the final form of carrier this produces a three-ply thickness between the handle openings, as shown in FIG. 13. If desired, additional thicknesses may be provided in like manner.

Although the carrier has been described in connection with a sleeve-type carrier for packaging bottles, it will be understood that it may be used to package other types of articles as well. The invention may also be employed in carriers having tapered end panels and straight side panels or in carriers having both straight ends and sides. The greatest dual benefit is derived, however, in carriers in which it is difficult to maintain the dust flaps firmly and tightly in place prior to folding and gluing the upper end panel flaps.

It will be understood that the invention is not limited to all the specific details described in connection with the preferred embodiments, except as they may be within the scope of the appended claims, and that changes to certain features of the preferred embodiments which do not alter the overall basic function and concept of the invention are contemplated.

What is claimed is:

1. An article carrier, comprising:

opposite side panels connected to a top panel and a bottom panel, the top panel having an outer face and an inner face;

opposite end panels connected to the top panel and the bottom panel;

each end panel being comprised of an upper end panel flap connected to the top panel and a dust flap connected to each side panel, the upper end panel flaps being adhered to the dust flaps;

the top panel including two handle openings therein, the handle openings being spaced apart transversely of the side panels; and a reinforcing strap having a first portion adhered to the inner face of the top panel and a second portion extending to a dust flap in at least one of the end panels, the first portion being located between the handle openings and the second portion being integrally connected to said dust flap.

2. An article carrier as defined in claim 1, wherein said dust flap includes a lower edge intermediate the top and bottom panels, the second portion of the reinforcing strap being connected by a fold line to said lower edge.

3. An article carrier as defined in claim 2, wherein the second portion of the reinforcing strap comprises a gusset web, the gusset web including a gusset fold line adjacent the top panel, the gusset fold line dividing the gusset web into a first segment extending from the gusset fold line to the first portion of the reinforcing strap and a second segment extending from the gusset fold line to the lower edge of said one dust flap.

4. An article carrier as defined in claim 3, wherein the first portion of the reinforcing strap is also adhered to the upper end panel flap in said one end panel.

5. An article carrier as defined in claim 4, wherein a portion of the first segment of the gusset web lies between a portion of the second segment of the gusset web and the portion of the reinforcing strap adhered to the upper end panel flap.

6. An article carrier as defined in claim 2, wherein the bottom panel has a length greater than the length of the top panel, the end panels having upper portions which taper inwardly toward the top panel.

7. An article carrier as defined in claim 6, wherein the bottom panel has a width greater than the width of the top panel, the side panels having upper portions which taper inwardly toward the top panel.

8. An article carrier as defined in claim 1, wherein the reinforcing strap includes a second portion extending from the top panel to a dust flap in each of the end panels.

9. An article carrier as defined in claim 8, wherein each end panel includes a lower end panel flap connected to the bottom panel, each lower end panel flap being adhered to associated dust flaps.

10. An article carrier as defined in claim 1, wherein the first portion of the reinforcing strap includes a second ply foldably connected to said first portion.

11. A blank for forming an article carrier, comprising:

a top panel section having opposite side edges and including two handle openings spaced apart transversely of the side edges;

a first side panel section connected to one of the side edges of the top panel section by a fold line and a second side panel section connected to the opposite side edge of the top panel section by a fold line;

a bottom panel section connected to the second side panel section by a fold line;

opposite end panel flaps connected to the top panel section by fold lines;

opposite dust flaps connected to the first side panel section by fold lines; and a reinforcing strap having a first portion adjacent the first side panel section and a second portion extending from opposite ends of the first portion to each of the dust flaps, each second portion being connected by a fold line to a dust flap;

the first portion of the reinforcing strap being located so that when the second portions of the reinforcing strap are folded about the fold lines connecting said second portions to the dust flaps, the first portion will lie between the handle openings in the top panel section.

12. A blank as defined in claim 11, wherein the dust flaps include an edge intermediate the upper end panel flaps and the first portion of the reinforcing strap, the fold lines connecting each second portion of the reinforcing strap to a dust flap substantially coinciding with said intermediate edge.

13. A blank as defined in claim 12, wherein each second portion of the reinforcing strap comprises a gusset web, each gusset web being connected to the first portion of the reinforcing strap by a diagonal fold line, each gusset web including an intermediate gusset fold line dividing the gusset web into two segments, the intermediate gusset fold line being adjacent the top panel in a carrier formed from the blank.

14. A blank as defined in claim 12, wherein the dust flaps include a portion of relatively narrow width relatively close to the second portion of the reinforcing strap and a portion of relatively great width more distant from the second portion of the reinforcing strap, each second portion of the reinforcing strap being spaced from the relatively narrow portion of an associated dust flap by a slit.

15. A blank as defined in claim 11, wherein the bottom panel section has a length greater than the length of the top panel section, the end panels in a carrier formed from the blank having upper portions which taper inwardly toward the top panel.

16. A blank as defined in claim 15, wherein the bottom panel section has a width greater than the width of the top panel section, the side panels in a carrier formed from the blank having upper portions which taper inwardly toward the top panel.

17. A blank as defined in claim 11, wherein the first portion of the reinforcing strap is separated from the first side panel section by a slit.

18. A blank as defined in claim 11, including opposite end panel flaps connected to the bottom panel section.

19. A blank as defined in claim 11, wherein the first portion of the reinforcing strap is foldably connected to a second ply flap.

* * * * *